United States Patent [19]

Burke

[11] 4,273,471

[45] Jun. 16, 1981

[54] MARINE-DRILLING SUB-BASE ASSEMBLY FOR A SOFT-BOTTOM FOUNDATION

[75] Inventor: Ben G. Burke, Lafayette, Calif.

[73] Assignee: Chevron Research Company, San Francisco, Calif.

[21] Appl. No.: 48,130

[22] Filed: Jun. 13, 1979

[51] Int. Cl.[3] ..... E02B 17/02; E02D 27/52

[52] U.S. Cl. ..... 405/203; 175/7; 405/205; 405/224

[58] Field of Search ..... 405/195, 203, 205, 206, 405/207, 211, 224; 175/5, 7, 9

[56] References Cited

U.S. PATENT DOCUMENTS

| | | | |
|---|---|---|---|
| 2,589,153 | 3/1952 | Smith | 405/224 X |
| 2,924,946 | 2/1960 | Goldman | 405/224 X |
| 3,859,803 | 1/1975 | Pedersen | 405/211 |

*Primary Examiner*—David H. Corbin

*Attorney, Agent, or Firm*—J. A. Buchanan, Jr.; R. L. Freeland, Jr.

[57] ABSTRACT

A drilling sub-base assembly for use from an offshore drilling vessel wherein drilling operations are conducted through a moon pool and at a drilling site where the bottom soil conditions are soft or unstable such that a conventional drilling sub-base dimensioned to pass through the moon pool would not provide an adequate foundational base for the carrying-on of drilling operations. The drilling sub-base assembly includes a main section dimensioned for ease of passage through the moon pool of the vessel and secondary sections pivotally affixed to the main section on at least two opposite sides thereof to be in a substantially vertical position relative to the main section when the drilling sub-base assembly is located in the moon pool and to be in a substantially horizontal position relative to the main section when the drilling sub-base assembly is positioned on the underwater bottom. With the secondary sections extended into their horizontal position and restrained from moving to a position above the horizontal, the drilling sub-base assembly provides the necessary cross-sectional bearing area to support drilling operations conducted into the soft underwater bottom. With the secondary sections in their vertical position, the drilling sub-base assembly may pass through the moon pool.

12 Claims, 11 Drawing Figures

MARINE-DRILLING SUB-BASE ASSEMBLY FOR A SOFT-BOTTOM FOUNDATION

FIELD OF THE INVENTION

The present invention relates to marine well drilling operations performed from offshore structures, and more particularly, to a drilling sub-base assembly for use on an underwater bottom having a soft bottom foundation wherein drilling operations are conducted through a moon pool of an offshore drilling vessel.

BACKGROUND OF THE INVENTION

Exploratory marine drilling operations are generally conducted from fixed, anchored or dynamically positioned floating offshore platforms—such as jack-up rigs, semi-submersibles and drill ships. Drilling operations conducted from these vessels, such as a drill ship, are normally conducted through a moon pool or a drillway through which drilling and other assemblies are passed. The dimensions of the moon pool, especially in the case of drill ships wherein the moon pool is usually located in the center of the ship's hull, necessarily limits the size of equipment that can be passed therethrough as equipment is lowered from and raised into the vessel.

When drilling at a subsea site where unstable soil conditions exist, for example, where the underwater bottom is comprised of unconsolidated silt or clay, the size of the moon pool presents a problem. Namely, a drilling sub-base dimensioned to pass through the moon pool may not provide sufficient bearing area to support drilling operations into the soft underwater bottom. To explain more fully, in normal offshore drilling operations, after the drill ship has been positioned above the drilling site, a drilling sub-base, having an aperture extending therethrough for passage of a drill bit, is lowered from the vessel and set into position on the underwater bottom. The drilling sub-base provides the necessary guidance means for drilling of a surface hole into the sea floor. After the surface hole has been drilled to an adequate depth, which is dependent upon the underwater bottom soil conditions, a foundation pile having a permanent drilling base fixedly connected thereto is lowered into the surface hole through the aperture in the drilling sub-base. The permanent drilling base is seated on the drilling sub-base and has its weight supported by the sub-base. The foundation pile is cemented in the surface hole to provide the foundational support necessary for further drilling. When drilling at an underwater site having a soft bottom that provides a weak foundational footing, drilling conducted through a drilling sub-base sized to pass through the drill ship's moon pool will likely cause a collapse or "wash-out" of the soil beneath the drilling base. This is because drilling fluid and cuttings produced by drilling of the surface hole flow to the top of the hole to erode the soil beneath the sub-base or to case the sides of the hole to slough away. When this occurs, the opening at the top of the surface hole becomes larger than the sub-base, resulting in the drilling sub-base literally falling into the surface hole. This will prevent further drilling.

In the past where soil conditions have required the use of a drilling sub-base of larger cross-sectional bearing area than that which can be lowered through a drilling vessel's moon pool, it has been the practice to "keel-haul" or tow the larger sub-base to the drilling site. This is an unsatisfactory solution to the problem as it entails an expensive and time-consuming operation.

Accordingly, the present invention is directed to a drilling sub-base assembly which is capable of easily passing through a moon pool of a drilling vessel and which is capable of providing the needed foundational support for conducting drilling operations into a soft underwater bottom.

SUMMARY OF THE INVENTION

Broadly speaking, the present invention comprises a drilling sub-base assembly which is designed for use from a marine drilling vessel having a moon pool of limited size wherein drilling operations are to be conducted at a subsea site having soft or unstable soil conditions. Under these conditions, a conventional drilling sub-base sized to pass through the vessel's moon pool will not provide the foundational support necessary for carrying-on drilling operations. The drilling sub-base assembly essentially includes a main section dimensioned for ease of passage through the moon pool with the main section having a centrally extending aperture through which drilling operations are conducted. Secondary sections are pivotally affixed to the main section on at least two opposite sides thereof to hang in a substantially vertical position relative to the main section when the drilling sub-base assembly is located in the moon pool. When the sub-base assembly is positioned on the underwater bottom, the secondary sections are in a substantially horizontal position relative to the main section. A restraint means is provided to prevent the secondary sections from moving to a position above the horizontal with respect to the main section. This permits the transfer of bearing forces from the secondary sections to the main section, thereby establishing the necessary foundational base for the carrying-on of drilling operations. When the secondary sections are in their vertical position, the drilling sub-base assembly is capable of passing through the vessel's moon pool. When the secondary sections are extended into their horizontal position, the sub-base assembly provides the requisite foundational support for drilling into a soft underwater bottom.

Positioning means are also provided on the drilling sub-base assembly. The positioning means establishes the secondary sections in their horizontal position prior to positioning the sub-base assembly on the underwater bottom. The positioning means also permits the secondary sections to be in their vertical position when the sub-base assembly is located in the moon pool. According to one embodiment, the positioning means comprises a relatively simple snap-lock arrangement wherein the secondary sections are raised into their horizontal position by means of tag lines. Alternatively, buoyancy means —such as buoyancy pods or buoyancy cans—may be attached to the secondary sections to establish the secondary sections in their respective horizontal and vertical positions. Also the secondary sections themselves may be constructed of buoyant material to have a neutral or slightly positive buoyancy.

The secondary section are appropriately sized, using established engineering practices, so that they and the main section provide the foundational support necessary for drilling at the particular drilling site. If operating at a subsea site having extremely weak soil conditions such that it would be impracticable to increase the size of the two secondary sections, secondary sections could then be pivotally affixed to each side of the main section to thereby provide a larger bearing area.

PRINCIPAL OBJECT OF THE INVENTION

The particular object of the present invention is to provide a drilling sub-base assembly for use from a marine drilling vessel wherein drilling operations are conducted through a moon pool and at a subsea site where soft soil conditions exist, the drilling sub-base assembly comprising a main section dimensioned for ease of passage through the moon pool and secondary sections pivotally affixed to the main section on at least two opposite sides thereof to hang in a substantially vertical position relative to the main section when the sub-base assembly is located in the moon pool and to extend into a substantially horizontal position relative to the main section and being restrained from moving above this position when the sub-base assembly is positioned on the underwater bottom.

Additional objects and advantages of the invention will become apparent from a detailed reading of the specification and drawings which are incorporated herein and made part of this specification.

DESCRIPTION OF THE PREFERRED EMBODIMENT

Figure 1:
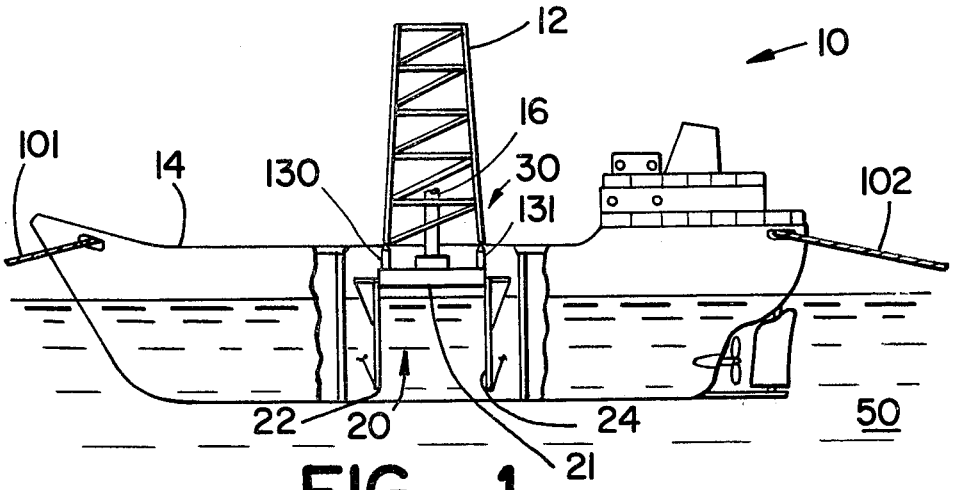
FIG. 1 is a schematic side elevation view, with parts broken away for clarity of presentation, illustrating an embodiment of the drilling sub-base assembly of the present invention as it is located in the moon pool of a drill ship.
Figure 3:
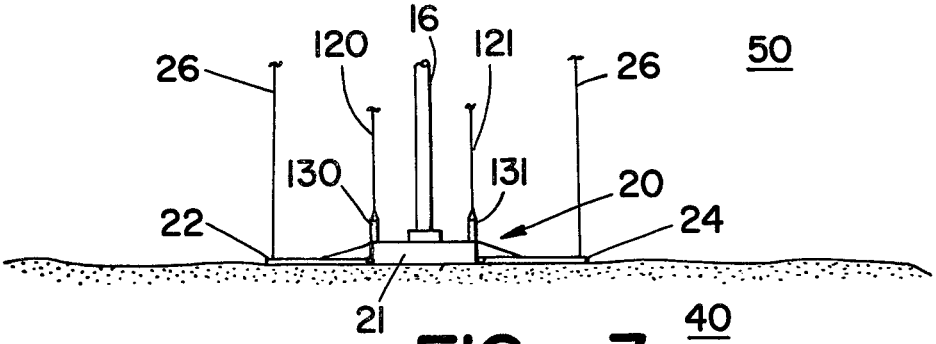
FIG. 3 illustrates the drilling sub-base assembly of FIG. 1 in position on the underwater bottom.
Figure 4:
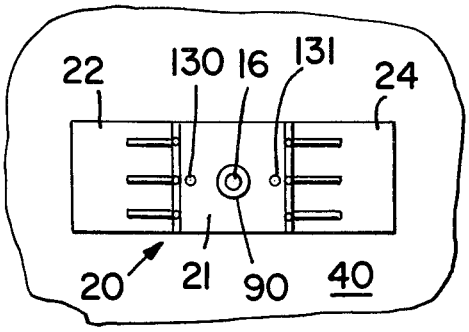
FIG. 4 is a schematic plan view of the drilling sub-base assembly as shown in FIG. 3.

Referring to the drawings and particularly to FIG. 1, there is illustrated an offshore drilling vessel or drill ship, generally designated by the reference numeral 10, which is statically positioned by means of lines 101 and 102 in a body of water 50 above a subsea site in the underwater bottom 40, see FIG. 3. As is known in the art, if the drill ship was operating in relatively deep waters, it would be dynamically positioned above the drilling site by such means as thrusters, which are not shown. A drilling rig 12 is located on the deck 14 of the drill ship to run drill pipe and handle cables and for the performance of the other functions that are well known in the underwater drilling art. A moon pool or drillway, indicated by reference numeral 30, extends from deck 14 through the hull of the vessel so that drilling equipment and other assemblies may pass from deck 14 during drilling operations.

In normal offshore drilling operations, the drilling vessel is positioned above the drilling site, and a drilling sub-base or temporary guide base having a centrally extending aperture formed therein is lowered by any appropriate means from the vessel to the subsea site. Once the drilling sub-base is set into position on the underwater bottom, it provides the necessary foundational support and guidance means for the drilling of a surface hole to an appropriate depth in the sea bottom. A foundation pile with a permanent drilling or guide base fixedly connected thereto is then lowered into and cemented in the surface hole to provide the requisite foundational support for further drilling. In drilling from a drill ship or other offshore drilling vessel, drilling operations are conducted through a moon pool. The dimensions of the moon pool necessarily limit the size and thus the cross-sectional bearing area of the drilling sub-base that may be passed through the moon pool. At some drilling sites, sea bottom 40 may be comprised of unconsolidated silt or clay or may have some other soil characteristics that provide a foundational footing that is too weak to support drilling operations conducted through a sub-base dimensioned to pass through the moon pool. In such instances, any attempt to drill a surface hole will cause soil beneath the sub-base to erode or will cause the sides of the surface hole to slough away. When this occurs, the opening at the top of the surface hole becomes larger than the sub-base, resulting in the sub-base falling into the hole.

To permit drilling into an underwater bottom having soft or unstable soil conditions, the present invention provides for the use of a drilling sub-base or template assembly, indicated by reference numeral 20, see FIGS. 1–4. Sub-base assembly 20 is capable of passing through moon pool 30, and it provides an adequate foundational base to support drilling into a soft underwater bottom. In FIGS. 1–4, there is illustrated one embodiment of the present invention wherein drilling sub-base assembly 20 essentially comprises a main section 21 that is dimensioned for ease of passage through moon pool 30 and which is lowered therethrough to be positioned on underwater bottom 40 by means of drill string 16. Drill string 16 is operatively connected in aperture 90 of main section 21 by a J-latch or any other appropriate means. On opposite sides of main section 21, secondary sections 22 and 24 are pivotally affixed to hang in a substantially vertical position relative to the main section so that the drilling sub-base assembly is free to pass through moon pool 30.

Figure 2:
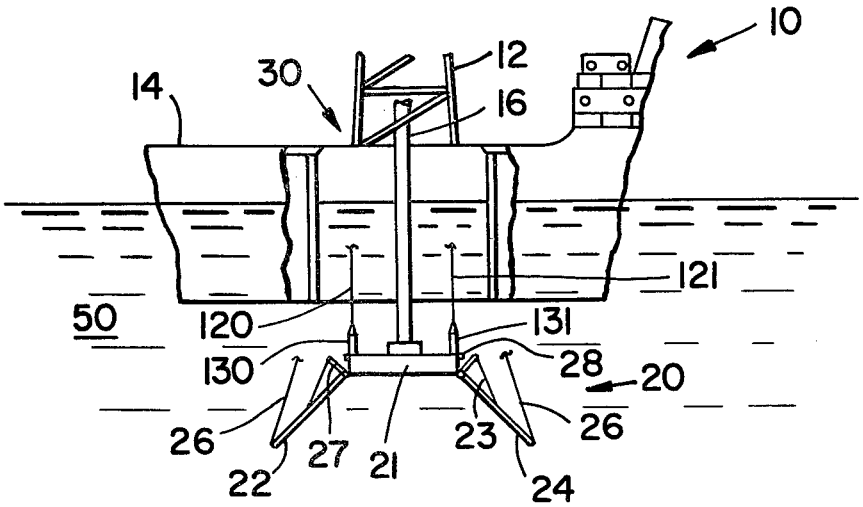
FIG. 2 illustrates the drilling sub-base assembly of FIG. 1 having passed through the ship's moon pool and being lowered to the underwater bottom.

After sub-base assembly 20 has passed through the vessel's moon pool, as illustrated in FIG. 2, secondary sections 22 and 24 may be raised, as will be discussed in more detail below, into a substantially horizontal position relative to main sectiion 21. Considering the particular soil conditions at the drilling site and the size of the main section which is limited by the dimensions of the moon pool, the secondary sections are dimensioned to provide—in conjunction with the main section—the requisite cross-sectional bearing area for supporting drilling operations into the soft bottom formation. Therefore, when the secondary sections are extended into the horizontal position and the drilling sub-base assembly is positioned on the underwater bottom, as shown in FIG. 3, a drilling sub-base is established at the subsea drilling site which provides the necessary foundational base to support drilling.

A positive stop or restraint means is provided on the sub-base assembly to prevent the secondary sections from rotating or moving to position beyond the horizontal relative to main section 21. This is necessary because if the secondary sections extend to a position above the horizontal, they will not provide the bearing area needed to support drilling operations. To this purpose, at least one bar or any other suitable member 27, see FIGS. 5–9, is fixedly connected to each of the secondary sections along the sides thereof where the secondary sections are pivotally joined to the main section. Therefore, when the secondary sections are extended into their horizontal position, member 27 will contact the side of main section 21 to prevent the secondary sections from opening to a position beyond the horizontal relative to the main section. It is noted that the restraint means may be any other appropriate configuration that prevents the secondary sections from moving to a position above the horizontal with respect to the main section.

The drilling sub-base assembly further includes, as illustrated in FIGS. 1–3, guidelines 120 and 121 fixedly connected to guide posts 130 and 131, respectively, which in turn are fixedly connected to main section 21. The guidelines extend between the guide posts and the drilling vessel where there are suitably connected to serve as a means to accurately position equipment, such as the drill bit and permanent drilling base, at the subsea drilling site. Any appropriate number of guide posts and guidelines deemed operably desirable may be used with the present invention. Alternatively, a guideline-less system, such as one where equipment is guided to the ocean floor by a television or sonar system, may be used with the present invention.

Figure 5:
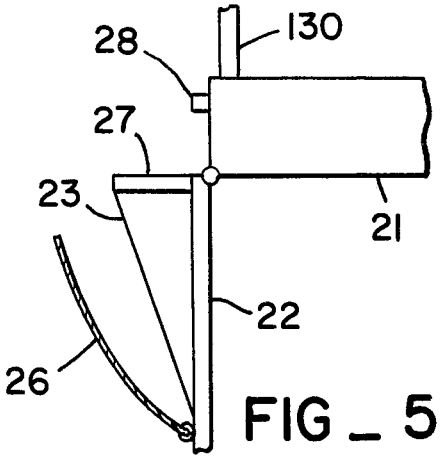
FIG. 5 is an enlarged fragmentary view of the drilling sub-base assembly of FIG. 1 illustrating the secondary sections of the drilling sub-base assembly in their vertical position.
Figure 6:
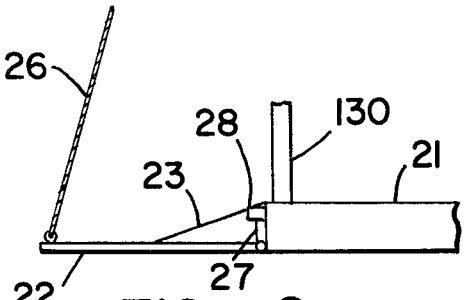
FIG. 6 is an enlarged fragmentary view of the drilling sub-base assembly in FIG. 3 illustrating the secondary sections of the drilling sub-base assembly in their horizontal position.
Figure 7:
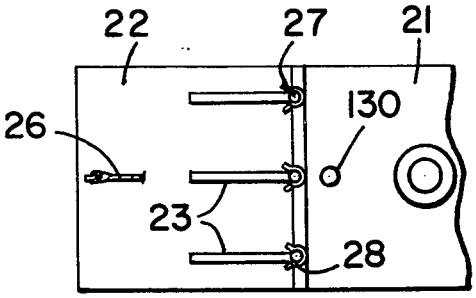
FIG. 7 is a plan view of the drilling sub-base assembly as shown in FIG. 6.

Positioning means are also provided on the drilling sub-base assembly, as shown in greater detail in FIGS. 5–7, for positioning the secondary sections in their respective horizontal and vertical positions. When the sub-base assembly is in the vessel's mool pool, the positioning means permits the secondary sections to be in their substantially vertical position as the weight of the secondary sections will cause them to hang, see FIG. 1, about the point where they are pivotally joined to the main section. To establish the secondary sections in their horizontal position, the positioning means illustrated—wherein only one of the secondary sections is shown as the arrangement of the positioning means is the same for both—includes at least one tag line 26 suitably connected to each of the secondary sections near the outer edge thereof. Of course, they may be connected at any other appropriate point on the secondary sections. Tag lines 26 extend between the sub-base assembly and the drill ship where they are appropriately secured so that an upward force may be applied to the secondary sections by means of the lines. After the sub-base assembly has been lowered through and is clear of the moon pool, the tag lines are used to raise the secondary sections into their substantially horizontal position. To secure the secondary sections in their horizontal position, a relatively simple snap-lock arrangement is provided. The snap-lock arrangement comprises a snap lock 28 located on main section 21 and so positioned to releasably engage bar 27 when the secondary sections are moved to their horizontal position. In this manner, the secondary sections are held in their horizontal position until at least the sub-base assembly is set into position on the underwater bottom. After sub-base assembly 20 is in position on underwater bottom 40, the bottom itself will support the secondary sections in the horizontal position.

In this embodiment and in the ones discussed below, as discussed heretofore, bars 27 which are latched into snap-lock 28 act as positive stops to prevent the secondary sections from opening beyond a horizontal position relative to the main section. Gussets 23 may also be fixedly connected between bars 27 and the secondary sections to provide structural support for the secondary sections when they are in their horizontal position. Although three separate bars 27 and respective snap-locks 28 and one tag line 26 for each secondary section are shown, it is understood that the present invention is not limited to any particular number, beyond the minimum required, as any number deemed operationally appropriate may be used. Further, it is noted that it would be possible to eliminate the snap-lock feature of this embodiment and simply use the tag lines to hold the secondary sections in their horizontal position.

Figure 8:
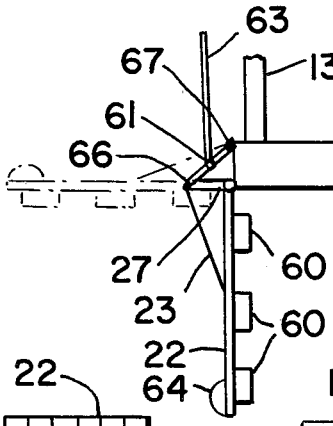
FIG. 8 is a schematic, fragmentary view illustrating an alternate embodiment of the present invention for establishing the secondary sections of the drilling sub-base assembly in their respective horizontal and vertical positions.

FIG. 8 illustrates an alternate embodiment of the positioning means of the present invention wherein buoyancy pod means 60 are affixed to each of the secondary sections—with only one of the secondary sections being shown as the buoyancy pod means are arranged in a like manner on each secondary section—to provide a buoyant force to raise the secondary sections into their horizontal position, which is shown in phantom. In this embodiment, buoyancy pods 60 are affixed to the underside of each of the secondary sections; alternatively, they could also be affixed to the upper surface of the secondary sections. As discussed, at least one bar 27 is fixedly connected to each of the secondary sections wherein a rod or other suitable member 61 is disconnectably connected between bar 27 and main section 21 by any appropriate means such as shear pins 66 and 67. Shear pins 66 and 67 extend through opposite ends of rod 61 to be secured to bar 27 and main section 21, respectively. With rod 61 connected in this position, a latching means is provided to hold the secondary sections in their vertical position, permitting the sub-base assembly to freely pass through the vessel's moon pool. Once the drilling sub-base assembly has cleared the moon pool, the latching means may be operated by disconnecting rod 61 from its position between the secondary and the main section by any suitable means—such as by pulling up on a latch line 63 to break shear pins 66 and 67—to allow the secondary sections to be buoyantly raised into their horizontal position. The above-described latching means may be any other arrangement which functions to hold the secondary sections in their vertical position when the sub-base assembly is in the vessel's moon pool and which can be operated to permit the secondary sections to extend into their horizontal position prior to positioning the sub-base assembly on the underwater bottom.

In the above embodiment, it would also be possible to provide a snap-lock on the main section, as discussed heretofore, to engage bar 27 such that the secondary sections are locked into their horizontal position. However, the snap-lock arrangement is really not necessary. As the drilling sub-base assembly is lowered to the underwater bottom, the buoyancy pods on the secondary sections will provide an uplifting force that keeps the secondary sections in their horizontal position. And once the base assembly is positioned on the underwater bottom, the bottom itself will support the secondary sections in the horizontal position.

Further, with respect to the embodiment shown in FIG. 8, it would be possible to simplify the apparatus of the positioning means by eliminating tag lines 63 and disconnectably connected bars 61. When the sub-base assembly is in moon pool 30, the secondary sections will be prevented from extending into their horizontal position due to the constraint place on them by the interior walls of the moon pool. Therefore, the secondary sections will remain in a substantially vertical position so that the sub-base assembly may pass through the moon pool. In this situation, it would be advisable to provide skid means 64 at the outer edges of the secondary sections to prevent damage to and ease passage of the secondary sections through the moon pool.

Figure 9:
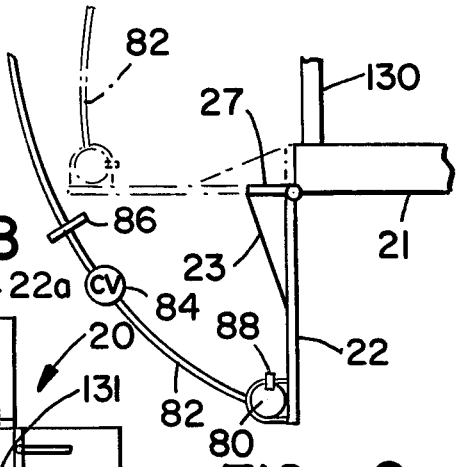
FIG. 9 is a schematic, fragmentary view illustrating still another embodiment of the present invention for establishing the secondary sections of the drilling sub-base assembly in their respective horizontal and vertical positions.

In FIG. 9, still another embodiment is illustrated for positioning the secondary sections in their respective horizontal and vertical positions. In this embodiment, at least one buoyancy or flotation can 80 is attached to the upper surface of each secondary section. Flotation cans 80 provide the buoyant force necessary to raise the secondary sections into the horizontal position, which is illustrated in phantom. When the drilling sub-base assembly is located in the vessel's moon pool, the buoyancy cans are empty and thus the secondary sections will hang in their substantially vertical position. When the drilling sub-base assembly has cleared the ship's moon pool, compressed air may be supplied to the buoyancy cans by means of an air line 82 to provide the buoyant force necessary to raise the secondary sections into their horizontal position. A check valve 84 is provided to prevent air from escaping from the buoyancy cans. A vent 88, which may be remotely operable from the drilling vessel, may also be provided to vent the buoyancy cans once the drilling sub-base assembly is positioned on the underwater bottom, since at this point an upward buoyant force is no longer needed to keep the secondary sections in their horizontal position. A remotely operable disconnect 86 for line 82 may also be provided so that the air line may be removed and stored after the sub-base assembly is positioned on the sea floor.

Figure 10:
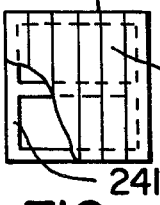
FIG. 10 is a schematic view that illustrates a secondary section as constructed from buoyant material.

In yet another embodiment, see FIG. 10, the secondary sections could be constructed so that they themselves have a negative or slightly positive buoyancy. Here, the secondary sections could be constructed to have a frame of air-tight tubular members 241 with a wooden deck 240 affixed to the frame. As with the embodiment shown in FIG. 8, the secondary sections will remain in their substantially vertical position when in the moon pool because of the constraint placed on them by the interior walls of the moon pool. After the sub-base assembly clears the moon pool, the secondary sections will be free to move to their substantially horizontal position. As discussed, restraint means will prevent the secondary sections from extending beyond the horizontal position.

Figure 11:
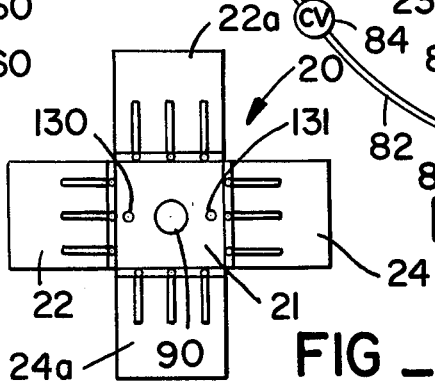
FIG. 11 is a schematic view illustrating an alternate embodiment of the drilling sub-base assembly of the present invention wherein secondary sections are affixed to each side of the main section of the drilling sub-base assembly.

In determining the dimension of secondary sections 22 and 24, it is preferred that they be no wider than the main section, whose dimensions are dictated by the dimensions of the moon pool. The length of the secondary sections may be limited by structural and handling requirements. If drilling operations are to be conducted at a site having extremely soft or unstable soil conditions—such that it is impracticable to increase the size of the secondary sections to provide the requisite cross-sectional bearing area—the embodiment of the present invention illustrated in FIG. 11 may be used. As shown in FIG. 11, two additional secondary sections **22*a* and 24*a* are provided so that a secondary section is pivotally attached to each side of main section 21. In this configuration, the size of the secondary sections are kept within workable limits while the drilling sub-base assembly provides the foundational base needed to support drilling into an extremely soft sea bottom. As with the embodiments discussed heretofore, an aperture 90** extends through the main section so that, as is known in the art, drill string and the drill bit may pass therethrough.

Referring to the above embodiments of the invention, if it becomes necessary to remove the drilling sub-base assembly from the underwater bottom, retrieval of the sub-base assembly may be accomplished essentially in the reverse manner from which it was set down. More particularly, referring to FIG. 3 wherein the secondary sections are locked into their horizontal position, the upward force applied to the drilling sub-base assembly in raising it from the underwater bottom will probably cause bar 27 to be released from lock 28. The secondary sections would then be free to hang in their vertical position, allowing the sub-base assembly to be raised through moon pool 30. If this does not occur, then when the drilling sub-base assembly is brought beneath drill ship 10, divers could be used to unlock the secondary sections so that they are free to hang in their vertical position. It is noted that any appropriate means, such as conductor pipe 16, may be used to raise the sub-base assembly from the underwater bottom.

In the buoyancy can arrangement of FIG. 9, it would be possible to vent buoyancy cans 80, if this has not already been done as discussed above, by means of vent 88 to remove the upward buoyant force applied to the secondary sections. This would permit the secondary sections to hang in the vertical position when the sub-base assembly is raised from the underwater bottom. Referring to the buoyancy pod construction of FIG. 8 wherein the secondary sections are not locked into the horizontal position and to the configuration of FIG. 10 where the secondary sections themselves are constructed of buyoant material, the secondary sections would be forced into their substantially vertical position as the drilling sub-base assembly is raised through the vessel's moon pool. Alternatively, referring to the embodiment of FIG. 8, it would be possible to use divers to replace bars 61 and the shear pins to latch the secondary sections into their vertical position to facilitate the raising of the sub-base assembly through the moon pool.

In the above discussion, it has been assumed that the main and secondary sections are essentially rectangular or square in shape. It is noted, however, the main and secondary sections may have any other suitable shape.

SUMMARY OF THE ADVANTAGES

The drilling template assembly of the present invention offers a drilling sub-base which is capable of passing through a moon pool of a drilling vessel wherein the moon pool is of limited size and which at the same time by an extension of its secondary sections into a horizontal position relative to the main section provides the requisite foundational base for operating at a drilling site having unstable soil conditions.

Although certain specific embodiments of the invention have been described herein in detail, the invention is not to be limited to only such embodiments, but rather only by the appended claims.

What is claimed is:

1. A drilling sub-base assembly for use at a site under a body of water having a soft-bottom foundation wherein drilling operations are conducted through a moon pool of an offshore drilling vessel, comprising:

a main section of the drilling sub-base assembly dimensioned for ease of passage through the moon pool, said main section having an aperture formed therein and being adapted to be positioned on the underwater bottom; and secondary sections pivotally affixed to said main section on at least two opposite sides thereof to hang from said main section to be in a substantially vertical position with respect thereto when the drilling sub-base assembly is located in the moon pool so that the drilling sub-base assembly may pass therethrough and said secondary sections in a substantially horizontal position relative to said main section when said drilling sub-base assembly is positioned on the underwater bottom wherein said secondary sections are restrained from moving to a position above the horizontal with respect to said main section so that the necessary foundational base for the carrying-on of drilling operations is provided.

2. A drilling sub-base assembly for use at a site under a body of water having a soft-bottom foundation wherein drilling operations are conducted through a moon pool of an offshore drilling vessel, comprising:

a main section of the drilling sub-base assembly dimensioned for ease of passage through the moon pool, said main section having an aperture formed therein and being adapted to be positioned on the underwater bottom;

secondary sections pivotally affixed to said main section on at least two opposite sides thereof to hang from said main section to be in a substantially vertical position with respect thereto when the drilling sub-base assembly is located in the moon pool so that the drilling sub-base assembly may pass therethrough and said secondary sections in a substantially horizontal position relative to said main section when said drilling sub-base assembly is positioned on the underwater bottom in order to provide the necessary foundational base for the carrying-on of drilling operations;

positioning means on the drilling sub-base assembly for providing that said secondary sections are in their substantially horizontal position when the drilling sub-base assembly is positioned on the underwater bottom and in their substantially vertical position when the drilling sub-base assembly is in the moon pool; and restraint means on the drilling sub-base assembly for preventing said secondary sections from moving to a position above the horizontal with respect to said main section when the drilling sub-base assembly is positioned on the underwater bottom so that the necessary foundational base for carrying-on drilling is established.

3. The drilling sub-base assembly of claim 2 wherein said secondary sections are pivotally affixed to each side of said main section.

4. The drilling sub-base assembly of claims 2 or 3 wherein said positioning means comprises:

tag line means affixed to said secondary sections to extend to the surface of the body of water in which said drilling sub-base assembly is located for raising said secondary sections from their substantially vertical position into their substantially horizontal position after the drilling sub-base has cleared the moon pool so that the drilling sub-base assembly may be set into position on the underwater bottom.

5. The drilling sub-base assembly of claim 4 wherein said positioning means further comprises locking means for securing said secondary sections in their horizontal position.

6. The drilling sub-base assembly of claims 2 or 3 wherein said positioning means comprises:

buoyancy means affixed to said secondary sections for applying a sufficient buoyant force to said secondary sections so that said secondary sections are in their substantially horizontal position when the drilling sub-base assembly is set into position on the underwater bottom wherein said secondary sections are in their substantially vertical position when said drilling sub-base assembly is in the moon pool.

7. The drilling sub-base assembly of claim 6 wherein said buoyancy means comprises flotation can means affixed to said secondary sections and control means for controlling the operation of said flotation can means.

8. The drilling sub-base assembly of claim 6 wherein said buoyancy means comprises buoyancy pods affixed to said secondary sections.

9. The drilling sub-base assembly of claim 8 wherein said buoyancy means further comprises latching means for holding said secondary sections in their substantially vertical position when the drilling sub-base assembly is located in the moon pool and means for operating said latching means so that said secondary sections are free to move to their substantially horizontal position once the drilling sub-base assembly has cleared the moon pool so that the drilling sub-base assembly may be set into position on the underwater bottom.

10. Apparatus for use at a subsea drilling site wherein drilling operations are conducted through a moon pool of limited size of an offshore floating structure, comprising:

a drilling sub-base assembly that is to be located at a subsea location where unstable soil conditions exist such that the underwater bottom provides relatively weak foundational footing for the carrying-on of drilling operations, said drilling sub-base assembly including a main section dimensioned to freely travel through the main pool of the offshore structure and having a central aperture extending therethrough, secondary sections pivotally affixed on at least two opposite sides of said main section to hang in a substantially vertical relationship relative to said main section when said drilling sub-base assembly is located in the moon pool of the offshore structure so that said drilling sub-base assembly may travel through the moon pool of the offshore structure and said secondary sections adapted to extend from said main section to be in a substantially horizontal relationship therewith when said drilling sub-base assembly is set into position on the underwater bottom to provide the foundational base necessary for the carrying-on of drilling operations, and means on said drilling sub-base assembly for providing that said secondary sections hang from said main section in substantially vertical relationship therewith when said drilling sub-base assembly is located in the moon pool of the offshore structure and for providing that said secondary sections extend from said main section and are restrained in a horizontal relationship therewith when said drilling sub-base assembly is positioned on the underwater bottom so that the necessary foundational base for drilling is established.

11. A method for drilling at a site under a body of water having a soft-bottom foundation wherein drilling operations are conducted through a moon pool of an offshore drilling vessel, comprising:

lowering a drilling sub-base assembly from an offshore drilling vessel through the moon pool wherein said drilling sub-base assembly includes a main section dimensioned for ease of passage through the moon pool and secondary sections pivotally affixed to said main section on at least two opposite sides thereof to be in a substantially vertical position with respect to said main section when said drilling sub-base assembly is in the moon pool;

extending said secondary sections from said substantially vertical position to a substantially horizontal position with respect to said main section after said drilling sub-base assembly has cleared the moon pool so that said drilling sub-base assembly may be positioned on the underwater bottom which said secondary sections in said substantially horizontal position; and positioning said drilling sub-base assembly on the underwater bottom with said secondary sections being restrained from moving to a position above the horizontal with respect to said main section so that the requisite foundational base for the carrying-on of drilling operations is provided.

12. The method of claim 11 wherein said drilling sub-base assembly is to be removed from the bottom, comprising:

raising said drilling sub-base assembly from the underwater bottom; and moving said secondary sections from said substantially horizontal position into said substantially vertical position prior to raising said drilling sub-base assembly through the moon pool.

* * * * *